United States Patent [19]

Rochman

[11] 4,336,952

[45] Jun. 29, 1982

[54] VEHICLE WITH A BALANCING PLANE

[76] Inventor: Arnold Rochman, 940 Bender Bldg., 1120 Conn. Ave. NW., Washington, D.C. 20036

[21] Appl. No.: 114,319

[22] Filed: Jan. 22, 1980

[51] Int. Cl.[3] ..... B62B 11/00

[52] U.S. Cl. ..... 280/87.01; 280/87.1

[58] Field of Search ..... 280/11.19, 11.2, 11.22, 280/11.23, 87.01, 87.02 R, 87.04 R, 87.04 A, 87.04 B, 265, 87.1

[56] References Cited

U.S. PATENT DOCUMENTS

| | | | |
|---|---|---|---|
| D. 214,177 | 5/1969 | Greer | 280/87.04 A |
| 1,247,801 | 11/1917 | Egge | 280/87.01 |
| 1,289,361 | 12/1918 | Bastman | 280/87.01 |
| 1,327,123 | 1/1920 | Thomas | 280/87.02 R |
| 1,445,219 | 2/1923 | Larson | 280/87.04 A |
| 2,136,019 | 11/1938 | Pfau | 280/87.01 |
| 3,039,784 | 6/1962 | Davis | 280/87.04 A |
| 3,069,182 | 12/1962 | Hufford | 280/87.01 |
| 3,684,305 | 8/1972 | McDonald et al. | 280/87.04 A X |
| 4,134,599 | 1/1979 | DiMille et al. | 280/87.01 |

FOREIGN PATENT DOCUMENTS

| | | | |
|---|---|---|---|
| 2440208 | 11/1978 | France | 280/87.04 A |

*Primary Examiner*—Joseph F. Peters, Jr.
*Assistant Examiner*—Michael Mar
*Attorney, Agent, or Firm*—Cushman, Darby and Cushman

[57] ABSTRACT

Transportation vehicle having a balance plane. In one embodiment the vehicle comprises a sitting skateboard including a pair of wheeled skateboard trucks mounted beneath an elongated planar platform, a balance board and a pair of handles being provided at the seat end of the platform. The front wheeled truck is fixed to a lazy susan-like mounting which may be locked against rotation in the horizontal plane of the platform but which when unlocked may be turned by the rider's feet with steering bars fixed to opposite sides of the front truck assembly. In a second embodiment the balance plane is formed at one end of a conventional surfboard to obtain a sitting surfboard.

3 Claims, 4 Drawing Figures

10
12
14
16
18
20
22
24
26
28
30
31
32
33
34
36
38
40
42
46
48
50

VEHICLE WITH A BALANCING PLANE

BACKGROUND OF THE INVENTION

The present invention relates to skateboards and surfboards and more particularly to a skateboard and a surfboard on which the rider may sit.

A sitting skateboard is a recreational vehicle which provides the excitement of coasting on a vehicle which may be steered only by shifting the rider's weight while permitting the additional comfort and control available when the rider is in a sitting position. Sitting skateboards are particularly desirable for the very young, inexperienced, or less coordinated rider or for an adult rider carrying a youthful passenger and who is particularly concerned about safety and control. There is therefore a particular need for control and safety features in sitting skateboards. However, prior sitting skateboards are lacking in this respect. For example, U.S. Pat. No. 3,039,784 issued to Davis (1962) discloses a seat coaster which includes a conventional roller skate supporting a frame in which the seat portion of the frame is substantially only as wide as the rider so that the rider has no place to hold onto the vehicle with his hands and may steer only by shifting his body weight to one side or the other with his hands free. U.S. Pat. No. 1,327,123 issued to Thomas (1920) discloses a coaster comprising two wheels respectively symmetrically mounted beneath the front and rear ends of a frame. Again, the frame is a single narrow platform of width approximately that of the rider and therefore provides the rider with support and control problems similar to those of the Davis coaster.

Surfboards are steered in a manner substantially the same as conventional standing skateboards. The rider stands on an elongated platform and steers by leaning to one side or the other. A sitting surfboard would have the same advantages of safety and control to the very young, inexperienced or less coordinated rider as does the sitting skateboard.

SHORT STATEMENT OF THE INVENTION

The sitting surfboard and sitting skateboard of the present invention overcomes a number of disadvantages of prior surfboards and sitting skateboards. The present skateboard includes a conventional rectangular planar platform to support an adult rider, and conventional wheeled skateboard trucks attached to the underside of the platform at opposite ends (the seat end and the foot end), which permit the skateboard to turn to the left and right in response to sideways tilting of the platform. Mounted across the sides of the seat end of the platform is an elongated board which provides leverage and control when the platform is tilted for balance and turning purposes. A pair of handles is provided at opposite sides of the top surface of the balance board, which the rider may grip for support. The handles also provide additional leverage when tilting the platform for turning purposes. Small wheels or ball bearings are mounted to opposite ends of the bottom surface of the balance board in order to eliminate scraping of the balance board against the ground when the skateboard is tilted to one side or the other. The provision of a balance board of this kind permits the rider to safely maneuver the skateboard by merely pushing downward on one or the other of the handles. A lesser degree of skill is therefore required to control and maneuver (steer) the present invention than is required to maneuver prior sitting skateboards.

In accordance with another feature of the skateboard of the invention, the wheeled truck at the foot end of the skateboard is mounted to the platform in such a manner that it may be released for rotation about a vertical axis when an increased steering capability is desired, or locked against rotation when conventional skateboard steering is desired. The structure of the mounting is similar to a "lazy susan". Foot bars extend outwardly from the bottom portion of the "lazy susan" for steering purposes.

By applying the principals of the present invention to a surfboard, a much safer and more controllable sitting surfboard is obtained. A preferably upwardly bowed balance board is provided at one end of a conventional surfboard. Slots at the outer ends of the balance board provide hand grips for a rider sitting on the surfboard at the balance board end. Thus, the provision of a balance board of this kind permits the rider to safely maneuver the surfboard by merely pushing down on one or the other of the grips.

BRIEF DESCRIPTION OF THE DRAWINGS

Further objects, features and advantages of the invention will become more fully apparent from the following detailed descriptions of the description of the preferred embodiment and the accompanying drawings in which.

DETAILED DESCRIPTION OF THE PREFERRED EMBODIMENTS

Figures 1, 2:
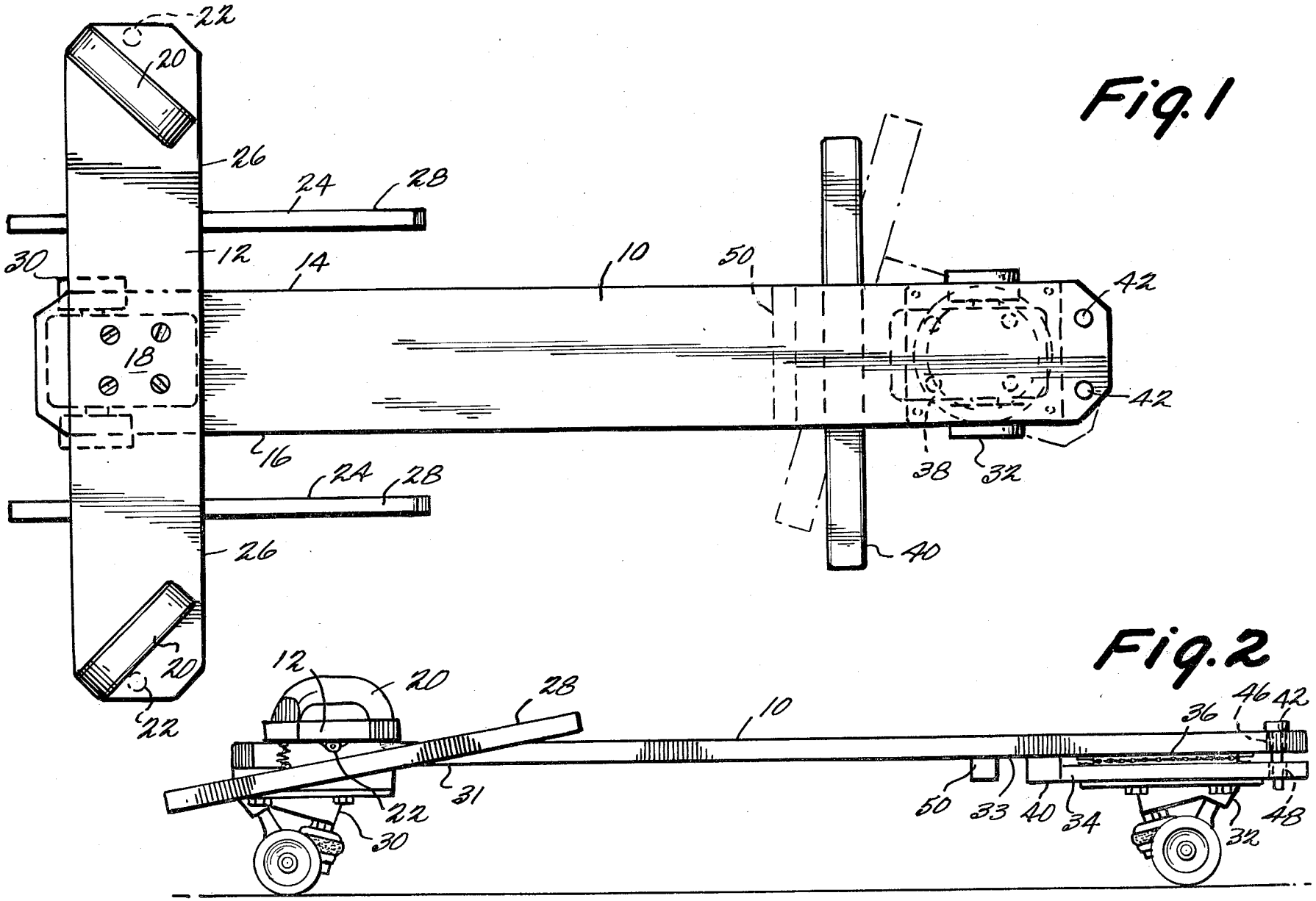
FIG. 1 is a schematic plan view of the preferred skateboard embodiment of the present invention.
FIG. 2 is a side view of the skateboard embodiment of the present invention.

Referring first to FIG. 1, there is shown a preferred sitting skateboard embodiment of the present invention. The skateboard includes an elongated planar platform 10 of sufficient length and width to support an adult rider in a sitting position. Mounted to the top surface of the platform 10 at one end thereof is a balancing plane 12 which extends equal lengths across the rear side edges 14 and 16 of the platform 10. The area of the intersection of balancing plane 12 and platform 10 may serve as the sitting area 18 for the rider. A pair of semicircular handles 20 extend vertically upward from balancing plane 12 at equal distances from platform side edges 14 and 16 so that the rider may grasp the handles when sitting on the skateboard in order to maintain his balance and otherwise control the skateboard.

Referring now to FIGS. 1 and 2, at opposite ends of balancing plane 12 are mounted ball bearings 22 which serve to prevent balancing plane 12 from scraping along the ground when the balancing plane is tilted to one side or the other. Other rotational means such as small wheels may be substituted for the ball bearings. Left and right brakes 24 are mounted to the front edge 26 of balancing plane 12. Brakes 24 may comprise any suitable braking mechanism, such as rods 28 hingedly mounted to opposite ends of front edge 26. A first conventional wheeled skateboard truck 30 is mounted to the rear undersurface 31 of platform 10, beneath sitting area 18. A second conventional wheeled skateboard truck 32 is mounted to the skateboard at the front undersurface 33 of platform 10. Wheeled truck 32 is fixed to a first planar member 34 which is in turn rotationally mounted to front undersurface 33 using a plurality of ball bearings 36 disposed within a circular track 38. A horizontal foot bar 40 is fixed to planar member 34 to provide foot support and steering of front wheeled truck 32. In order to permit the skateboard to operate in a conventional manner, that is, to permit turning only by leaning the body to one side or the other, the forward truck 32 is releasably fixed against rotation by a pair of bolts 42 respectively inserted in matched pairs of holes 46 and 48, formed in platform 10 and planar member 34. Over turning the front wheel structure is prevented by a block 50, protruding from undersurface 33 slightly behind foot bar 40 which limits the rotation of planar member 34.

In order to operate the sitting skateboard of the present invention, the rider sits with his seat disposed over rear area 18 and his feet resting on opposite ends of foot bar 40. When the skateboard is in motion, the rider may hold each handle 20 with his hands in order to maintain balance and may turn to the left of right by either leaning in the direction of the desired turn or pushing downward on the handle on the side of the desired turn. Pushing down on the handle 20 provides particularly sensitive control of the turning of the skateboard. The high degree of control permitted by the balancing plane and handles makes the skateboard easily controllable by a child, or by an adult carrying a child between his legs. If bolts 42 are removed from holes 46 and 48, the skateboard may be additionally steered with the feet.

Figure 3:
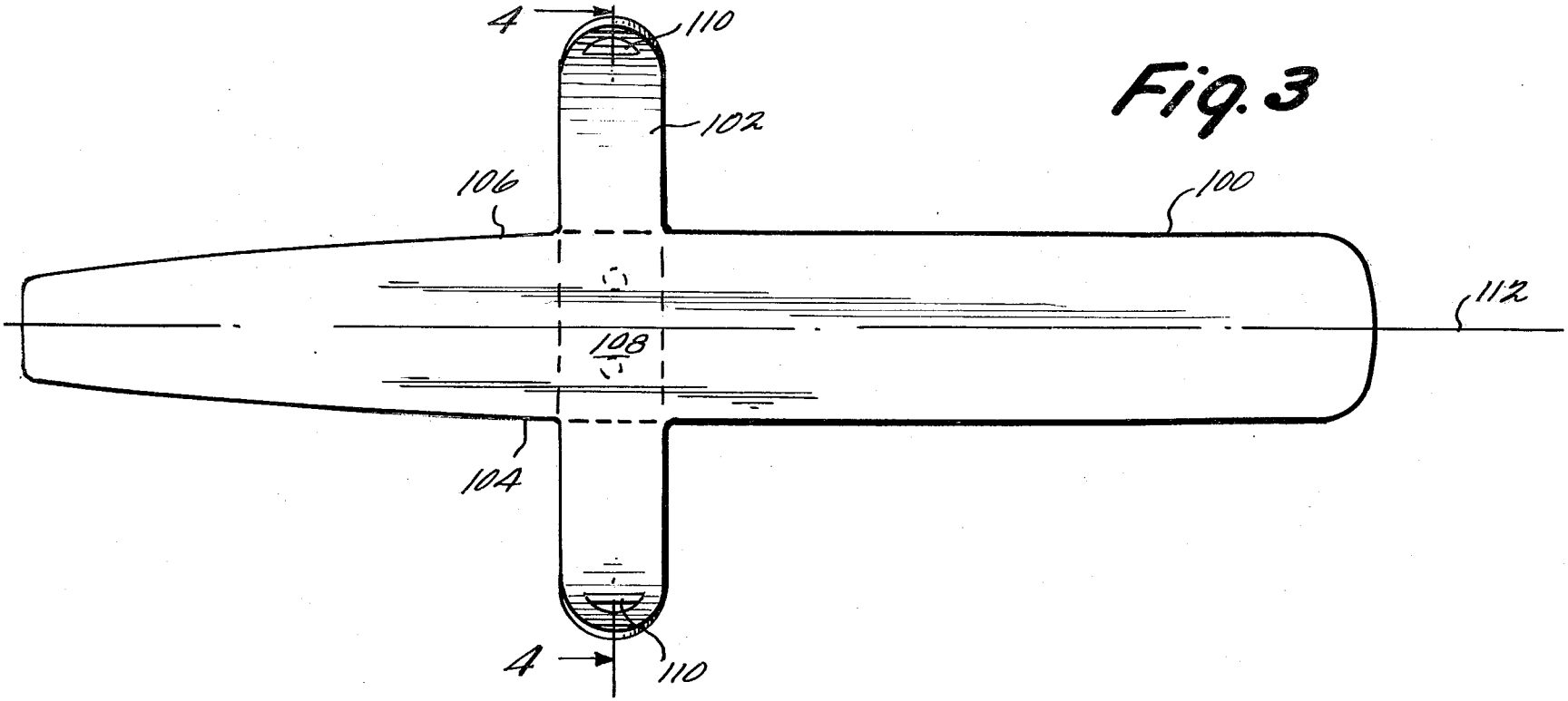
FIG. 3 is a schematic plan view of the surfboard embodiment of the present invention.

Referring now to FIG. 3, there is shown a preferred sitting surfboard embodiment of the present invention. The surfboard includes an elongated platform 100 such as a conventional surfboard. Mounted to the top surface of platform 100 at one end thereof is a balancing plane 102, preferably bowed upward and extending equal length across the platform rear side edges 104 and 106. The area of intersection of balancing plane 102 and platform 100 serves as the sitting area 108 for the rider. Slots 110 are formed at opposite ends of the balancing plane 102 so that the rider may grasp the end of the balancing plane when sitting on the surfboard in order to maintain his balance and to otherwise control the surfboard. The bottom surface of the board 100 has a convex shape so as to be responsive to tilting about its longitudinal axis 112 for turning the surfboard in the direction of tilt. The balancing plane may be fixed at its central portion to the board 100 by any suitable means. For retrofitting existing skateboards, the bow-shaped balancing plane 102 can be fixed with screws or glue. With the manufacture of new surfboards, the balancing plane can be fitted into the board 100, so that the top surface of the balancing plane 102 is flush with the top surface of board 100.

Figure 4:
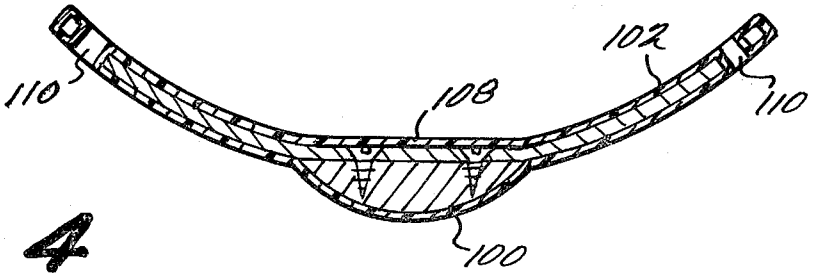
FIG. 4 is a sectional view of the surfboard embodiment taken along line 4—4 of FIG. 3.

The upward extending bow-shape of the balancing plane is best illustrated in FIG. 4. This design provides a higher position of the balancing plane outer edges so that possible contact of these edges with water is minimized when making sharp-turning maneuvers. This design also obviates the function of the ball bearings utilized in the sitting skateboard embodiment of the invention described above.

Although only two exemplary embodiment of this invention has been described in detail above, those skilled in the art will readily appreciate that many modifications are possible in the exemplary embodiment without materially departing from the novel teaching and advantages of this invention. Accordingly, all such modifications are intended to be included within the scope of this invention as defined in the following claims.

What is claimed is:

1. A coaster device comprising:

an elongated planar platform for supporting a rider, said platform having a forward and rearward end, an underside and a longitudinal center line extending along the length of said platform;

wheeled truck means connected to said underside of said platform along said center line for turning to the left and right of said center line in response to the tilting of said platform respectively to the left and right about said center line;

said wheeled truck means including at least one steerable, rotatable wheel, pivotally mounted to said platform for pivoting about an axis perpendicular to the plane of said platform, and means engagable with said platform, and said truck means, for releasably locking said wheel against pivoting;

means mounted to said platform at said rearward end for tilting said platform to the left and to the right, said tilting means including an elongated balance board having an upper surface and a transverse line extending perpendicularly to said longitudinal center line at one end of said platform; and a pair of handles fixed to said balance board at opposite sides of said platform for providing leverage when tilting said platform.

2. The coaster device of claim 1 further comprising means rotatably mounted to said underside of said balance board at opposite ends of said transverse line and normally spaced above the ground for rotatably engaging the ground when said platform and balance board tilt a predetermined distance to the left or right about said first center line.

3. The coaster device of claim 1 or 2 further comprising means pivotally mounted to said balance board for braking longitudinal movement of said coaster.

* * * * *